US006099277A

United States Patent [19]

Patel et al.

[11] Patent Number: 6,099,277

[45] Date of Patent: Aug. 8, 2000

[54] GAS BLOWER AND METHOD UTILIZING RECIRCULATION OPENINGS

[75] Inventors: Ajitkumar G. Patel, Oxford, Ohio; David A. Bell, Connersville, Ind.

[73] Assignee: Dresser Industries, Inc., Dallas, Tex.

[21] Appl. No.: 09/133,076

[22] Filed: Aug. 12, 1998

[51] Int. Cl.[7] ..... F04C 18/18

[52] U.S. Cl. ..... 418/1; 418/15; 418/180; 418/206.4

[58] Field of Search ..... 418/1, 9, 15, 180, 418/206.4

[56] References Cited

U.S. PATENT DOCUMENTS

| | | | |
|---|---|---|---|
| Re. 29,627 | 5/1978 | Weatherston | 418/180 |
| 3,121,529 | 2/1964 | Hubrich | 418/180 |
| 5,702,240 | 12/1997 | O'Neal et al. | 418/206.4 |

FOREIGN PATENT DOCUMENTS

| | | | |
|---|---|---|---|
| 64-32085 | 2/1989 | Japan | 418/15 |

*Primary Examiner*—John J. Vrablik
*Attorney, Agent, or Firm*—Haynes & Boone LLP

[57] ABSTRACT

A gas blower and method according to which the gas is introduced into the inlet of a housing where it is pressurized by rotating impellers. The pressurized gas is directed to a discharge plenum from which a first portion of the gas is discharged. The remaining portion of the gas is passed from the discharge plenum through a plurality of openings to a recirculating chamber for recirculating the gas back to the housing. The gas is passed from the recirculating chamber back to the housing through two radially-spaced sets of angularly-spaced openings formed in the housing.

8 Claims, 2 Drawing Sheets

GAS BLOWER AND METHOD UTILIZING RECIRCULATION OPENINGS

BACKGROUND OF THE INVENTION

This invention relates to an gas blower and a method for discharging gas from a blower, and more, particularly, to such a blower and method having an improved air discharge pattern.

Rotary positive blowers have long been used in the art for receiving a gas, such as air, compressing it and discharging the compressed air for use externally.

Several designs of rotary positive blowers include a housing having an inlet plenum and an outlet plenum respectively registering with an inlet opening and an outlet opening respectively formed in opposed walls of the housing. The inlet plenum receives ambient air and introduces into the housing, and the outlet plenum receives the pressurized, or compressed, air and discharges it for further use.

Many of these designs include two "figure eight" impellers disposed in the housing and mounted on vertically-spaced, parallel shafts mounted for rotation in the housing in opposite directions. The shafts extend generally perpendicular to the flow path of air though the housing, as each impeller passes the inlet opening, it traps a definite volume of air and carries it around the housing to the outlet for discharge.

However, due to the difference between the pressures of the trapped volume of air and the discharge plenum, a sudden rush of air into the trapped volume of air occurs when an impeller passes the outlet opening. This rush of air causes shock, vibration, pulsation and noise, all of which are highly undesirable.

In order to minimize these disadvantages, the assignee of the present application has marketed an improved blower design under the "Roots Whispair" trademark. According to this design, jet openings are defined in the outlet plenum to recirculate some of the air from latter area back to the area of the housing that receives the impellers and the incoming air is trapped by the impellers simultaneously with the discharge of the pressurized air. This causes a gradual equalizing of the pressure of the trapped air and the pressure in the discharge area and reduces the shock, vibration, pulsation and noise caused by the conventional blowers discussed above.

Although this latter design has been eminently successful, there is still room for improvement. For example, there is an abrupt change in the discharge flow area which causes sudden changes in the discharge air velocity and results in turbulances, which, in turn, cause added pressure drop and noise.

SUMMARY OF THE INVENTION

According to the gas blower and method of the present invention, a gas, such as air, is introduced into the inlet of a housing where it is pressurized by rotating impellers. The pressurized gas is directed to a discharge plenum from which a first portion of the gas is discharged. The remaining portion of the gas is passed to a recirculating chamber for recirculating the gas back to the housing. The gas is passed from the recirculating chamber back to the housing through two radially-spaced sets of angularly-spaced openings formed in the housing.

As a result, a distinct advantage is achieved by the blower and method of the present invention since sudden changes in the discharge gas velocity, and the resulting pressure drop, turbulence and noise, are all avoided.

DETAILED DESCRIPTION OF THE PREFERRED EMBODIMENT

Figure 1:
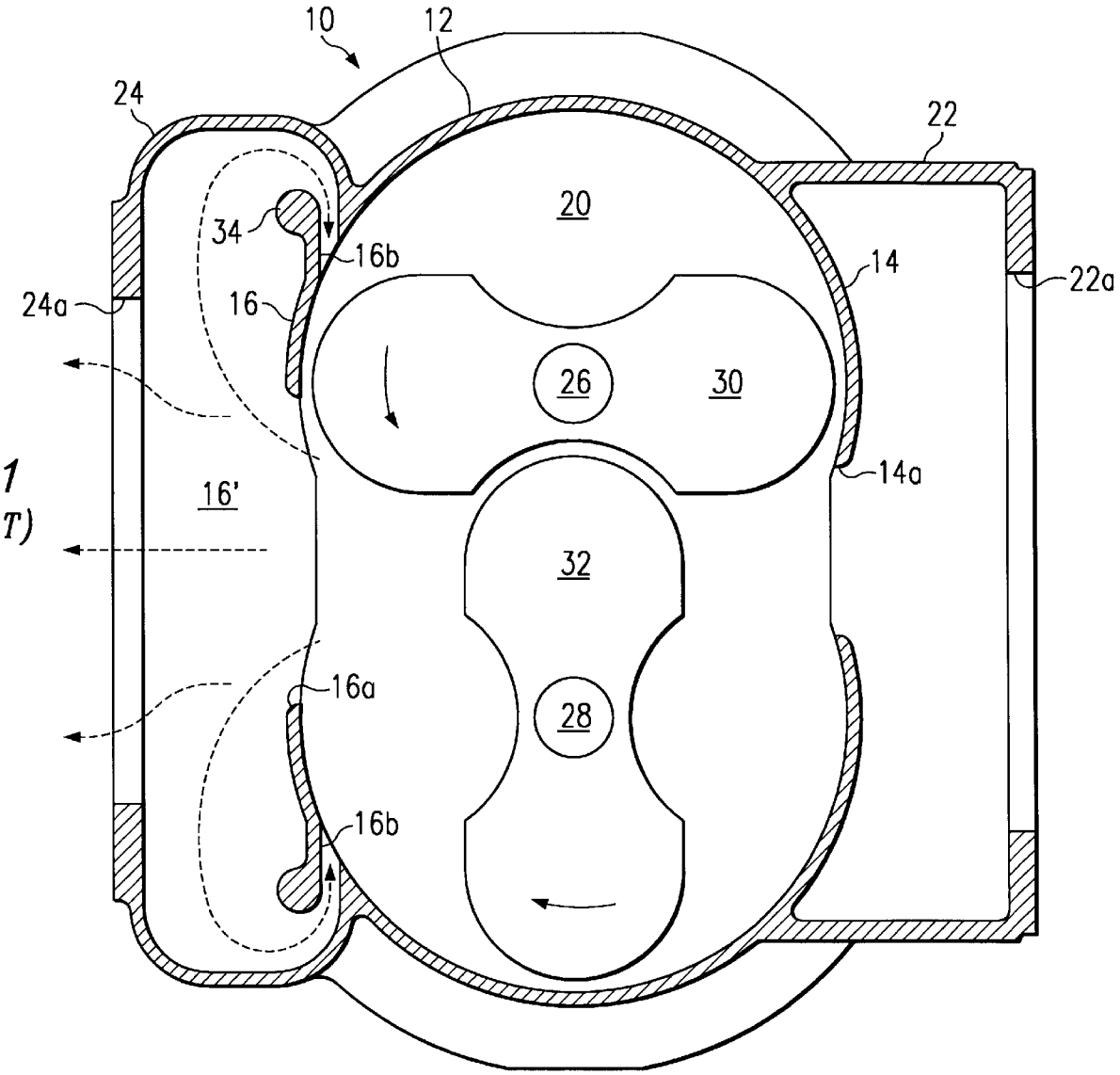
Fig. 1 (PRIOR ART)
FIG. 1 is a cross-sectional view of a blower according to the prior art.

Referring to FIG. 1 of the drawings, the reference numeral 10 refers, in general to an air blower of the prior art discussed above. The blower 10 includes a housing 12 having two curved opposed walls 14 and 16 having an inlet opening 14*a* and a discharge opening 16*a* respectively extending therethrough. The openings 14*a* and 16*a* communicate with a chamber 20 defined by the walls 14 and 16 and two spaced end walls (not shown).

An inlet plenum 22 extends from the wall 14 and has an inlet opening 22*a* for receiving ambient air, and a discharge plenum 24 extends from the wall 16 and has a discharge opening 24*a* for discharging the air. Two horizontally-extending, vertically-spaced shafts 26 and 28 are disposed in the chamber 20 and are mounted for rotation in bearings, or the like (not shown). It is understood that at least one motor (not shown) is provided in the housing for driving the shafts in opposite directions, in a conventional manner.

Two impellers 30 and 32 are mounted on the shafts 26 and 28, respectively, for rotation therewith and each has a general "figure 8" shape. The impellers 30 and 32 are angularly positioned on their respective shafts 26 and 28 so that the end portions of each impeller "nest" in the necked down portion of the other impeller as shown during rotation of the impellers.

A plurality of angularly-spaced jet passages, two of which are referred to by the reference numeral 16*b*, are is formed in the wall 16 in an radially outwardly-spaced relation to the discharge opening 16*a*. The passages 16*b* are defined in part by an annular extension, or flange 34 that extends from the wall 16 and is provided with an enlarged, rounded outer portion. The flange 34 functions to direct air in the discharge plenum 24 through the jet passages 16*b* and back to the chamber 20.

In operation of the prior art blower of FIG. 1, the shafts 26 and 28 are driven to cause them, as well as their corresponding impellers 30 and 32, to rotate in opposite directions indicated by the arrows on the impellers. This draws ambient air into the inlet opening 22*a* of the inlet plenum 22, through the inlet opening 14*a* in the wall 14 of the housing 12 and into the chamber 20. The air is pressurized in the housing 12 by the rotating impellers 30 and 32 before being discharged, via the outlet opening 16*a* of the wall 16, to the discharge plenum 24.

A portion of the air in the discharge plenum 24 is discharged from the plenum directly through the discharge opening 24*a* as shown by the dotted flow arrows. The remaining portion of the air flows in the plenum 24 in the general direction shown by the dashed flow arrows and passes through the passages 16*b* and back into the chamber 20 for recirculation.

The incoming air is trapped by the impellers 30 and 32 simultaneously with the discharge of some of the pressurized air from the discharge plenum 24 through the discharge opening 24*a*. The recirculation of the remaining air in the discharge plenum 24 through the passages 16*b* back into the chamber 20 causes a gradual equalizing of the pressure of the trapped air and the pressure in the discharge plenum. As a result, shock, vibration, pulsation and noise that would otherwise occur are considerably reduced. However, as stated above, this flow of the air in the discharge plenum 24 causes sudden changes in the discharge gas velocity and results in turbulances, which, in turn cause pressure drop and noise.

Figure 2:
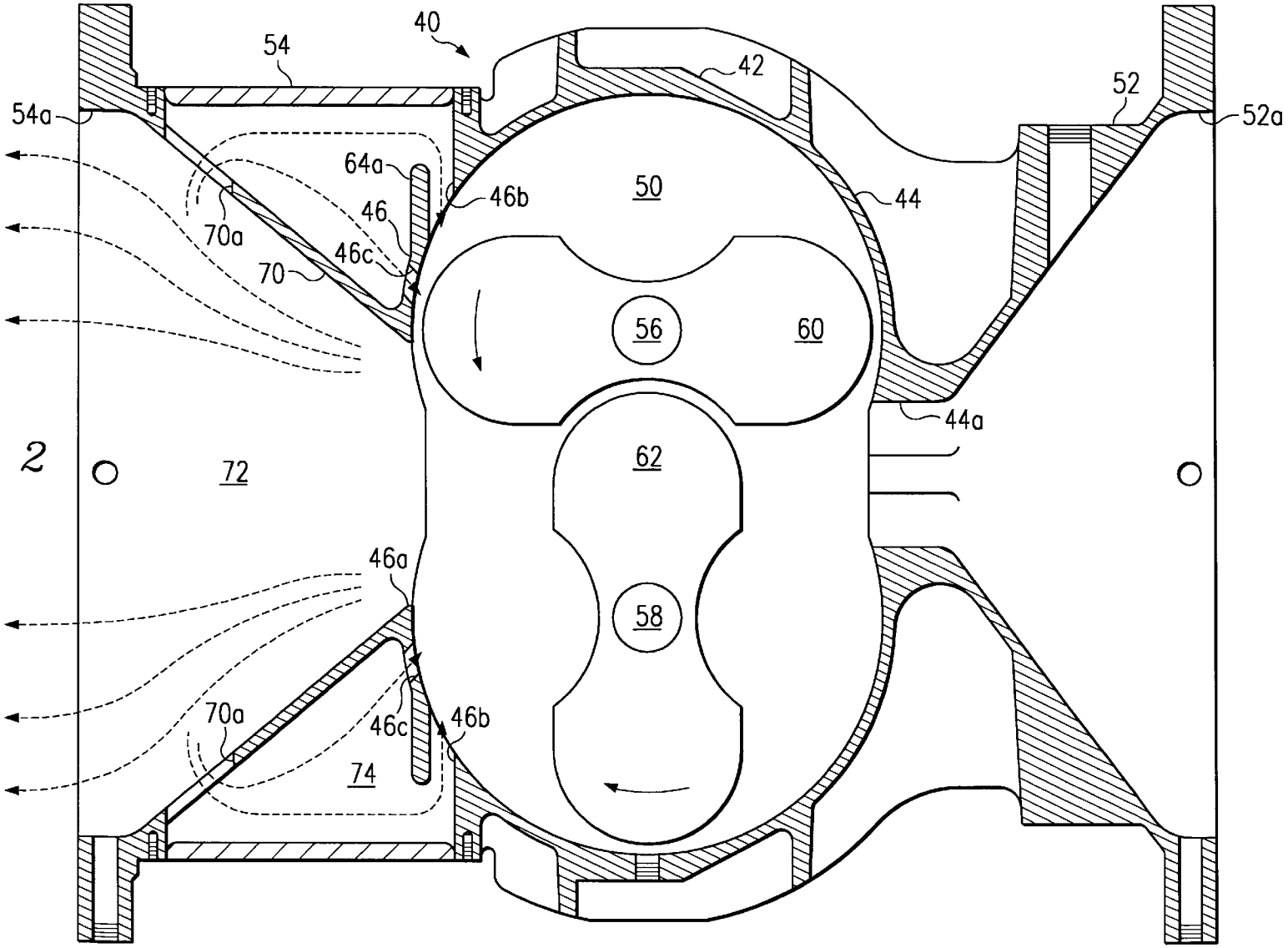
FIG. 2 is a cross-sectional view of the blower of the present invention.

This is overcome by the blower of the present invention which is referred to, in general, by the reference numeral 40 in FIG. 2. The blower 40 includes a housing 42 having two opposed curved walls 44 and 46 having an inlet opening 44*a* and a discharge opening 46*a*, respectively, extending therethrough. The openings 44*a* and 46*a* communicate with a chamber 50 that is defined by the walls 44 and 46 and two spaced end walls (not shown).

An inlet plenum 52 extends from the wall 44 and has an inlet opening 52*a* for receiving ambient air, and a discharge plenum 54 extends from the wall 46 and has a discharge opening 54*a* for discharging the air. Two horizontally-extending, vertically spaced-shafts 56 and 58 are disposed in the chamber 50 and are mounted for rotation in bearings, or the like (not shown). It is understood that at least one motor (not shown) is provided in the housing for driving the shafts in an opposite direction, in a conventional manner.

Two impellers 60 and 62 are mounted on the shafts for rotation therewith and each has a general "figure 8" shape. The impellers 60 and 62 are angularly positioned on their respective shafts 56 and 58 so that the end portions of each impeller "nest" in the necked down portion of the other impeller as shown during rotation of the impellers.

A plurality of angularly spaced jet passages, two of which are referred to by the reference numeral 46*b*, are formed in the wall 46 radially outwardly from the discharge opening 46*a*. The passages 46*b* are defined in part by an annular extension, or flange 64*a* that extends from the wall 46 and functions to direct air through the jet passages 46*b* to the chamber 50.

According to a feature of the present invention, a frusto-conical partition 70 is provided in the discharge plenum 54 and defines a discharge chamber 72 in the center of the discharge plenum, and an annular recirculation chamber 74 surrounding the discharge chamber. A plurality of angularly-spaced openings, two of which are shown by the reference numeral 70*a*, are formed through the partition 70 for permitting some of the air in the discharge chamber to flow into the recirculation chamber 74.

According to another feature of the present invention, a plurality of angularly-spaced jet openings, two of which are referred to by the reference numeral 46*c*, are provided in the wall 46 between the discharge opening 46*a* and the jet passages 46*b*. The openings 46*c* also function to direct air in the discharge plenum 54 back into the chamber 50.

In operation of the blower of FIG. 2, the shafts 56 and 58 are driven to cause them, as well as their corresponding impellers 60 and 62, to rotate in opposite directions indicated by the arrows on the impellers. This draws ambient air into the inlet opening 52*a* of the inlet plenum 52, through the inlet opening 44*a* in the wall 44, and into the housing 42 where it enters the chamber 50. The air is pressurized in the chamber 50 by the rotating impellers 60 and 62 before being discharged, via the outlet opening 46*a* in the wall 46, to the discharge chamber 72 of the discharge plenum 54. A portion of the air in the chamber 72 is discharged directly through the discharge opening 54*a* as shown by the dotted flow arrows. The remaining portion of the air flows through the openings 70 into the recirculation chamber 74, and from the latter chamber, through the jet passages 46*b* and the jet openings 46*c*, and back into the chamber 50 for recirculation, as shown by the dashed flow arrows.

Thus, the incoming air is trapped by the impellers 60 and 62 simultaneously with the discharge of some of the air from the discharge chamber 72 through the outlet opening 54*a*, with the remaining air being recirculated back into the chamber 50.

The air blower and method of the present invention thus enjoys several advantages. For example the pressure of the trapped air and the pressure in the discharge plenum are gradually equalized to reduce the shock, vibration, pulsation and noise that would otherwise occur. In addition, the openings 70*a* in the partition restrict the flow of the air from the discharge chamber 72 to the recirculation chamber 74 and the addition of the jet passages 46*c* provides a relatively high flow of the air from the recirculation chamber back to the chamber 50. This eliminates any abrupt changes in the velocity of air discharging from the discharge chamber 72 through the discharge opening 54*a*. As a result, any turbulances are minimized or eliminated which insures that there will be little, if any increase in pressure drop and noise.

It is understood that variations may be made in the above without departing from the scope of the present invention. For example, the blower and method of the present invention are not restricted to use with air, but can be used with any type of gas. Also, the number and arrangement of the impellers can vary. Further, the specific orientation and spacing of the shafts and impellers discussed above can vary.

It is understood that other variations, modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A blower comprising a housing comprising a first wall portion, an inlet formed through the first wall portion for receiving a gas, a second wall portion, an outlet formed through the second wall portion for discharging the gas, a first series of recirculation openings formed through the second wall portion, and a second series of recirculation openings formed through the second wall portion; impeller means in the housing for receiving the gas from the inlet, pressurizing the gas, and passing the gas to the outlet for discharge; and a separator extending between the first and second series of openings for respectively directing a first portion of the gas exiting from the outlet to the first series of openings for recirculation back into the housing, and a second portion of the gas exiting from the outlet to the second series of openings for recirculation back into the housing.

2. The blower of claim 1 wherein the separator is a flange extending from the housing.

3. The blower of claim 2 wherein the outlet is a circular opening formed in a wall of the housing, wherein the first series of recirculation openings extend through the wall and are radially spaced from the circular opening, wherein the second series of recirculation openings extend through the wall and are radially spaced from the first series of recirculation openings, and wherein the flange is annular.

4. The blower of claim 1 comprising a discharge plenum extending from the other wall for receiving the gas from the outlet, and a partition disposed in the discharge plenum for dividing the plenum into a discharge chamber communicating with the outlet for receiving the gas from the outlet and discharging a portion of the gas, and a recirculation chamber communicating with the discharge chamber and the first and second series of recirculation openings for receiving the remaining portion of the gas from the discharge chamber directing the latter portion to the first and second series of discharge openings.

5. The blower of claim 4 wherein the partition has an opening for permitting the remaining portion of the gas to pass from the discharge chamber into the recirculation chamber.

6. A method of processing gas comprising the steps of introducing the gas into the inlet of a housing, pressurizing the gas in the housing and passing the pressurized gas to an outlet in the housing for discharge, recirculating a portion of the gas discharging from the outlet back towards the housing, and providing a separator for separating the latter portion of the gas into two quantities of gas and directing the two quantities of gas back into the housing through a first and second series of openings, respectively.

7. The method of claim 6 further comprising the step of passing the gas from the outlet to a discharge plenum, discharging some of the gas from the discharge plenum, and recirculating the portion of the gas from the discharge plenum into the housing through the first and second series of openings.

8. The method of claim 6 further comprising the step of passing the portion of the gas through a recirculating chamber before the portion of gas is passed back into the housing.

* * * * *